US008417151B2

(12) United States Patent
Kikushima et al.

(10) Patent No.: US 8,417,151 B2
(45) Date of Patent: Apr. 9, 2013

(54) COMPONENT REPLACEMENT SUPPORT TOOLS FOR FUSING UNIT

(75) Inventors: Yuuki Kikushima, Ibaraki (JP); Genichiro Kawamichi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 13/016,269

(22) Filed: Jan. 28, 2011

(65) Prior Publication Data

US 2011/0194872 A1 Aug. 11, 2011

(30) Foreign Application Priority Data

Feb. 5, 2010 (JP) ..... 2010-024472

(51) Int. Cl.
*G03G 15/16* (2006.01)

(52) U.S. Cl.
USPC ..... 399/122; 219/216; 432/76

(58) Field of Classification Search ..... 399/109, 399/122; 432/76
See application file for complete search history.

(56) References Cited

U.S. PATENT DOCUMENTS

| | | | | |
|---|---|---|---|---|
| 5,301,000 | A | 4/1994 | Heigl | |
| 5,953,561 | A | 9/1999 | Tashiro et al. | |
| 6,442,360 | B1 | 8/2002 | Onodera et al. | |
| 8,249,486 | B2 * | 8/2012 | Onodera et al. | 399/122 |
| 2004/0190939 | A1 | 9/2004 | Yamanaka | |
| 2011/0052258 | A1 * | 3/2011 | Kamoshida et al. | 399/122 |
| 2011/0182620 | A1 * | 7/2011 | Kawamichi | 399/123 |
| 2011/0188883 | A1 * | 8/2011 | Tokuyama et al. | 399/109 |

FOREIGN PATENT DOCUMENTS

| | | |
|---|---|---|
| EP | 1 976 337 A1 | 10/2008 |
| JP | 5-504633 | 7/1993 |
| JP | 6-011984 | 1/1994 |
| JP | 11-52818 | 2/1999 |
| JP | 2001-143520 | 5/2001 |
| JP | 2002-23535 | 1/2002 |
| JP | 2002-214950 | 7/2002 |
| JP | 2002-278336 | 9/2002 |
| JP | 2002-311729 | 10/2002 |
| JP | 2008-4293 | 1/2008 |
| JP | 4130373 | 5/2008 |

* cited by examiner

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A component replacement support tool for a fusing unit with a roller that contains a lamp cartridge includes a roller insertion/removal guide shaft and a lamp protection member detachably housed in the roller insertion/removal guide shaft. The fusing unit includes a replacement opening via which the roller or the lamp cartridge can be removed from or inserted into the fusing unit along an axis of the roller for replacement. The roller insertion/removal guide shaft is inserted into the roller along the axis of the roller and fixed so as to guide the roller when the roller is removed from or inserted into the fusing unit via the replacement opening. The lamp protection member is inserted between the roller and the lamp cartridge when the lamp cartridge is pulled out of or inserted into the roller along the axis of the roller via the replacement opening.

8 Claims, 18 Drawing Sheets

RELATED ART

RELATED ART

RELATED ART

COMPONENT REPLACEMENT SUPPORT TOOLS FOR FUSING UNIT

BACKGROUND OF THE INVENTION

1. Field of the Invention

The present invention relates to component replacement support tools used for the replacement of a heating roller, a pressure roller, or a lamp cartridge in a fusing unit of an image forming apparatus, such as a laser printer.

2. Description of the Related Art

In an image forming apparatus such as a laser printer or a copy machine, a recording medium with an un-fused toner image carried thereon is heated and pressed between a heating roller and a pressure roller of a fusing unit in order to fuse the toner image onto the surface of the recording medium. The heating roller typically contains heater lamps as a heat source. Generally, as the printing speed or the ream weight increases, the image forming apparatus requires a larger amount of heat for fusing the toner image. Thus, the heating roller needs to be maintained at higher temperatures in order to provide higher fusing temperatures.

When the heating roller is replaced at the end of its lifespan, typically a maintenance worker first needs to stop the operation of the image forming apparatus and then wait until the heating roller is cooled down to a temperature allowing the removal of the heating roller from the fusing unit for replacement. In this case, however, it takes a long time before the heating roller is sufficiently cooled, resulting in low operation efficiency. The image forming apparatus also needs to be stopped for a long time during the replacement work, resulting in not only a decrease in the operational efficiency of the image forming apparatus but also in an increase in the replacement/maintenance cost.

In recent years, there has been an increasing need for higher printing speed and image quality, and also for the capability for handling various kinds of printing sheets. When high-speed printing is required, the surface of the heating roller may be coated with a thin layer of a PFA (tetrafluoroethylene/perfluoroalkylvinylether copolymer) resin so that the heat for fusing the toner image can be quickly transmitted from the heating roller to the recording medium. When a higher image quality is required, the surface of the heating roller may be coated with silicon rubber so that the toner image can be prevented from being blurred or stained on the recording medium upon fusing. When the durability of the heating roller is of concern while a certain level of image quality also needs to be maintained, the silicon rubber layer of the heating roller may be coated with PFA tube. Thus, there is a demand for the use of several kinds of heating rollers.

Such demand may be addressed by providing various heating rollers in a single image forming apparatus so that one of the heating rollers can be selected depending on the requirement. However, the heating rollers generally have large thermal capacities, although there may be some differences depending on the type of the heating roller. Thus, a long time is generally required before any of the heating rollers is cooled down from the high temperature for fusing to a lower temperature for replacement.

FIG. 1 is a cross section of a portion of a fusing unit discussed in JP05-504633A. FIG. 2 is a perspective view illustrating how the fusing unit is replaced. As illustrated in FIG. 1, one end of the heating roller 100 is supported on a frame 102 via a support flange 101. The support flange 101 is fitted in an open end of the heating roller 100 together with a centering member 104 via a bearing 103. While not illustrated, the other end of the heating roller 100 is similarly supported on another support flange via a bearing. The support flange 101 is fixed to the frame 102 by a thumbscrew 106. A retaining nail 108 is attached to the support flange 101 via a thumbscrew 107. The retaining nail 108 is configured to fix the heating roller 100 at the time of replacing the heating roller 100.

In the heating roller 100, plural heater lamps 105 are disposed of which one end is retained at the center of the support flange 101 via a retaining member 109. While not illustrated, the other end of the heater lamps 105 is similarly retained on the corresponding support flange via a retaining member. A connector 110 is disposed at the end of the heater lamps 105. With the heater lamps 105 retained at the center of the support flange 101, the connector 110 protrudes beyond the support flange 101, as illustrated in FIG. 1. To the support flange 101, a grip 111 is integrally attached which is used when replacing the heating roller 100. The grip 111 is disposed to straddle over the connector 110.

When replacing the heating roller 100, the thumbscrew 106 is unfastened and the heating roller 100 is pulled out of the frame 102, together with the support flange 101 or the like, while holding the grip 111 with one hand, as illustrated in FIG. 2. The opening of the frame 102 may be lined with felt so as to prevent damage to the heating roller 100 upon contacting the frame 102.

The heating roller 100 is typically a cylinder having a diameter of about 100 mm and a length of about 500 mm or more, with more than a little weight. Accordingly, in the case of the fusing unit according to Patent Document 1, it is not easy for the maintenance worker to pull the heating roller 100 out of the frame 102 together with the support flange 101 and the like stably. Specifically, even though the grip 111 is held with one hand and the heating roller 100 is held with the other gloved hand 120, the pulling-off operation may be destabilized due to the weight of the heating roller 100 and heat. As a result, the heating roller 100 may come into contact with other components, such as the frame 102, resulting in a damage to the roller surface.

Thus, according to the above conventional technology, the posture of the heating roller 100 tends to be unstable and no supporting tool is described for stabilizing the posture of the heating roller 100. There is also the danger of burning the hands of the maintenance worker by the high-temperature heating roller 100 even if the hands are gloved. Further, a mold release agent or lubricant on the heating roller 100 may become attached to the gloved hand 120, thereby not just staining the hand but also hindering the replacing operation.

Further, when the heating roller 100 is pulled out of the frame 102 together with the support flange 101 and the like by holding the grip 111 with one hand, the roller surface may be scratched upon contact with the frame 102. While the opening of the frame 102 may be lined with felt for protection of the heating roller surface, the mold release agent or lubricant on the heating roller 100 may be transferred onto the felt and may remain on the felt as dirt, which may potentially damage the surface of the heating roller 100. The felt also needs to be affixed and removed each time the heating roller 100 is replaced. The removed felt needs to be disposed of and new felt needs to be prepared.

In order to prevent the damage to the heater lamps when pulling them out, JP2002-23535A proposes the following. FIG. 3 is a cross section of a lamp cartridge 127 discussed in this publication. When pulling the lamp cartridge 127 out of a heating roller 114, an operator moves to the rear of the image forming apparatus (the side of a second lamp holder 129; i.e., to the left of FIG. 3). The operator then inserts a lamp protection member 164 into a through-hole 159*a* of a housing 159 until an inner circumferential portion of the lamp protection member 164 is fitted in a retaining portion 130 of the first lamp holder 128, thus securely positioning the lamp protection member 164.

The operator then moves to the front of the image forming apparatus (i.e., to the right-side of FIG. 3 where the first lamp holder 128 is disposed) and withdraws a regulating member 165 from a concave portion (not shown) formed in the first lamp holder 128, thus freeing the regulation of the movement of the lamp cartridge 127 in an axial direction. Then, the lamp cartridge 127 is pulled out of the heating roller 114 together with the lamp protection member 164.

In this method, damage to the lamp cartridge 127 upon its detachment or attachment may be prevented and the lamp cartridge 127 may be handled more easily. However, the lamp protection member 164 cannot be used for replacing the heating roller 114; namely, a separate jig is required for replacing the heating roller 114, thus requiring various jigs. In addition, the jigs for replacing the lamp protection member 164 and the heating roller 114 need to be individually managed and stored, requiring additional space for the replacing operation or during storage.

When the lamp protection member 164 is inserted into the image forming apparatus until the front end of the lamp protection member is fitted in the first lamp holder 128, how far the lamp protection member 164 should be inserted has been left to the discretion of the individual operator based on experience or guess-work. Consequently, the operator may decide to pull the lamp cartridge 127 when the lamp protection member 164 is not fully fitted in the first lamp holder 128, thereby potentially damaging the lamp cartridge 127.

When a new lamp cartridge 127 is attached within the image forming apparatus, the lamp protection member 164 (lamp cartridge 127) is inserted from the right of FIG. 3 such that the lamp protection member 164 can pass through central openings of heating roller lids 115*a* and 115*b* of the heating roller 114. In this case, because the inside of the image forming apparatus cannot be visually monitored with the naked eye, it is difficult to pass the lamp protection member 164 through the central openings, particularly the one in the heating roller lid 115*b* located down the inserted direction.

SUMMARY OF THE INVENTION

The disadvantages of the related art may be overcome by the present invention which, in one aspect, is a component replacement support tool for a fusing unit having a roller that contains a lamp cartridge, the fusing unit including a replacement opening via which the roller or the lamp cartridge can be removed from or inserted into the fusing unit along an axis of the roller for replacement. The tool includes a roller insertion/removal guide shaft; and a lamp protection member detachably housed in the roller insertion/removal guide shaft. The roller insertion/removal guide shaft is configured to be inserted into the roller along the axis of the roller and fixed therein so as to guide the roller when the roller is removed from or inserted into the fusing unit via the replacement opening. The lamp protection member is inserted between the roller and the lamp cartridge when the lamp cartridge is pulled out of or inserted into the roller along the axis of the roller via the replacement opening.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENTS

Laser Printer

Figure 1:
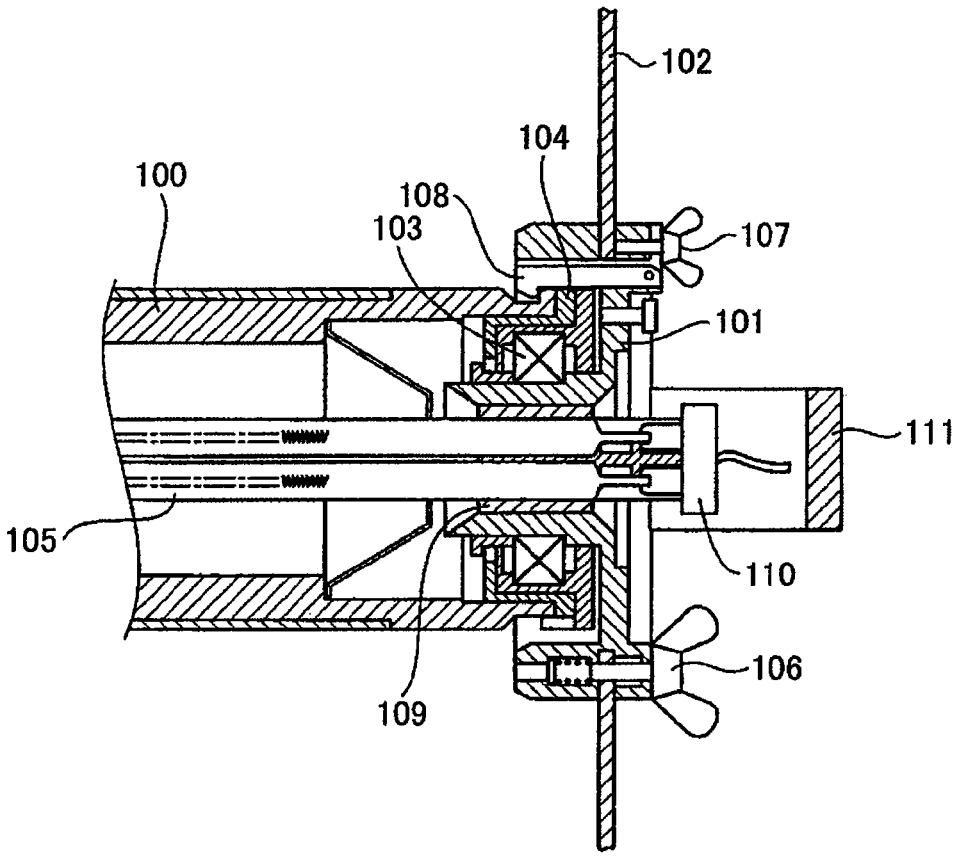
FIG. 1 is a cross section of a part of a fusing unit according to an example of related art.
Figure 2:
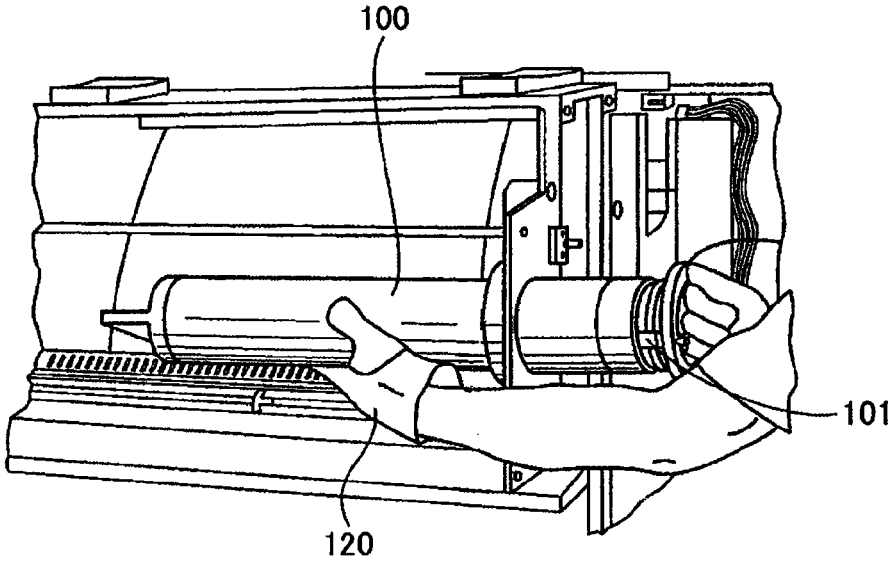
FIG. 2 is a perspective view illustrating how a heating roller is pulled out of the fusing unit for replacement.
Figure 3:
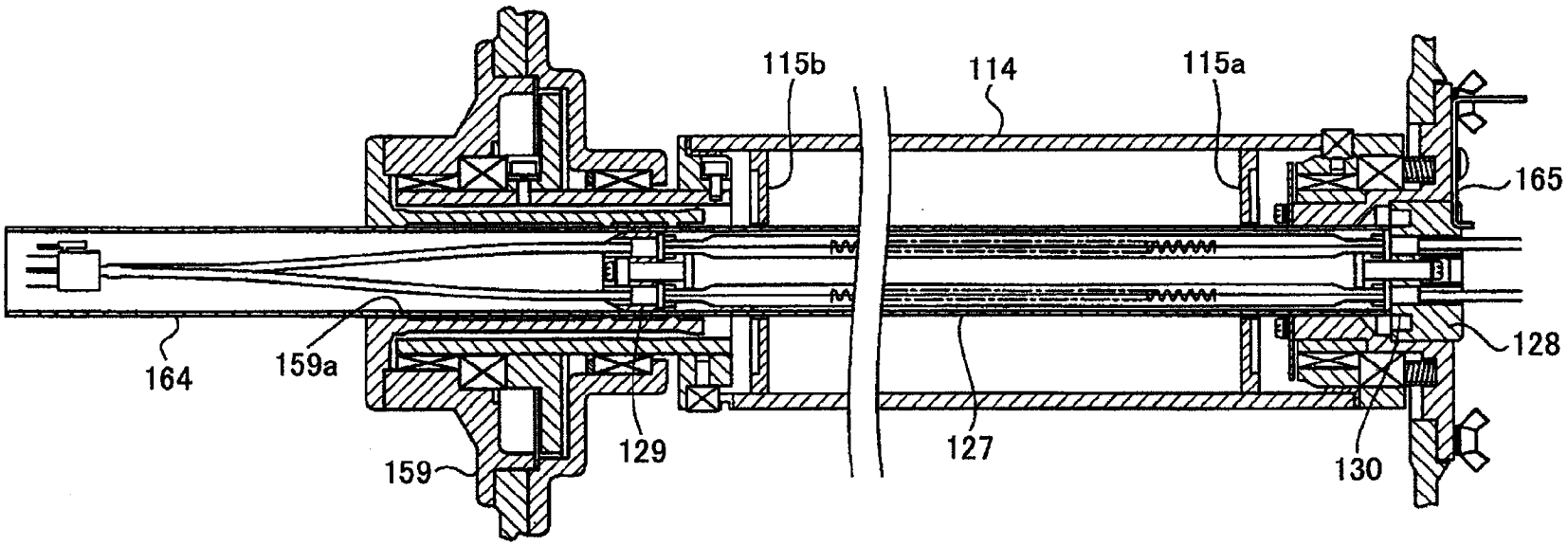
FIG. 3 is a cross section of a fusing unit according to another example of related art.
Figure 4:
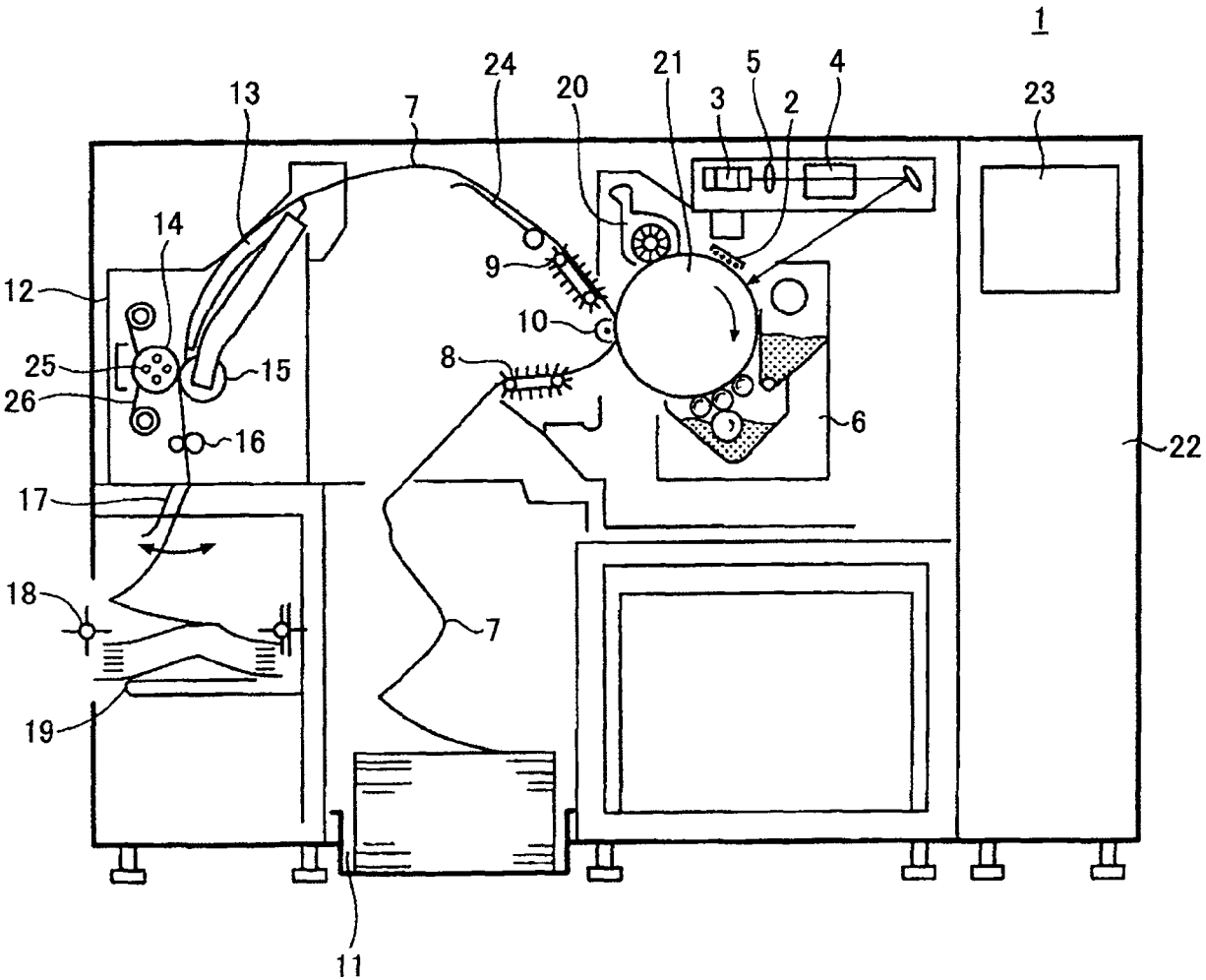
FIG. 4 illustrates a laser printer according to an embodiment of the present invention.

FIG. 4 illustrates a laser printer 1 based on the principle of electrophotography according to an embodiment of the present invention. The laser printer 1 includes a photosensitive drum 21 that rotates in a direction indicated by an arrow on the drum, in accordance with a printing operation start signal from a controller 22. The photosensitive drum 21 is rotated until the end of a printing operation at a speed corresponding to a printing speed of the laser printer 1. When the photosensitive drum 21 is rotated, a high voltage is applied to a corona charger 2 in order to charge the surface of the photosensitive drum 21 with positive charges, for example, uniformly.

Immediately after the laser printer 1 is turned on, a rotating polygonal mirror 3 starts to rotate and keeps its rotation at a precisely constant speed as long as the laser printer 1 is on. A light source 4, which may include a semiconductor laser, emits light which is reflected by the rotating polygonal mirror 3. The reflected light then irradiates (scans) the surface of the photosensitive drum 21 via an fθ lens 5. Character data or figure data in dot image form are supplied from the controller 22 to the laser printer 1 as a laser beam on/off signal. The surface of the photosensitive drum 21 is partially irradiated with the laser beam in accordance with the on/off signal, whereby an electrostatic latent image is formed on the photosensitive drum 21.

When the region of the photosensitive drum 21 where the electrostatic latent image is retained is located opposite a developing unit 6, the developing unit 6 supplies toner to the electrostatic latent image. The toner, which may be positively charged, is electrostatically attached to the portions on the photosensitive drum 21 where the charges have been removed by the laser beam irradiation, thereby forming a toner image on the photosensitive drum 21.

A continuous sheet (recording medium) 7 is stored in a sheet hopper 11. The sheet 7 is transported by a sheet transport tractor 8 to a gap (transfer area) between the photosensitive drum 21 and a transfer unit 10 in accordance with the timing of the arrival of the toner image on the photosensitive drum 21. In the transfer area, the transfer unit 10 provides charges of the opposite polarity to that of the toner image to the back side of the sheet 7, so that the toner image can be transferred onto the sheet 7.

The sheet 7 is then transported to a fusing unit 12 via the sheet transport tractors 8 and 9, the transfer unit 10, and the buffer plate 24. In the fusing unit 12, the sheet 7 is initially heated by a preliminary heater 13 which may include plural heater elements. The sheet 7 is then passed through a nipping area between a heating roller 14 and a pressure roller 15 (fusing rollers). In the nipping area, the sheet 7 is heated and pressed by the fusing rollers 14 and 15 so that the toner image can be fused onto the sheet 7. The heating roller 14 may include plural heater lamps 25.

The sheet 7 is further transported by a sheet ejecting roller 16 and ejected into a stacker table 19. Specifically, the sheet 7 is folded along its perforations in alternate directions by a swinging movement of a swing fin 17, while the folds of the sheet 7 are put in order by a rotating paddle 18. The area of the photosensitive drum 21 that has passed through the transfer area is cleaned by a cleaning unit 20 in preparation for the next round of a printing operation.

The buffer plate 24 is configured to absorb any slack or tension in the sheet 7 due to a sheet transport speed difference between the sheet transport tractor 9 and the fusing rollers (heating roller 14 and pressure roller 15). Information about the status of the laser printer 1 during the printing operation may be displayed by a display screen 23. A web member 26 is wound across a pair of rolls in a retrievable manner and configured to apply a mold release agent or lubricant to the surface of the heating roller 14.

Structure Near the Heating Roller

Figure 5:
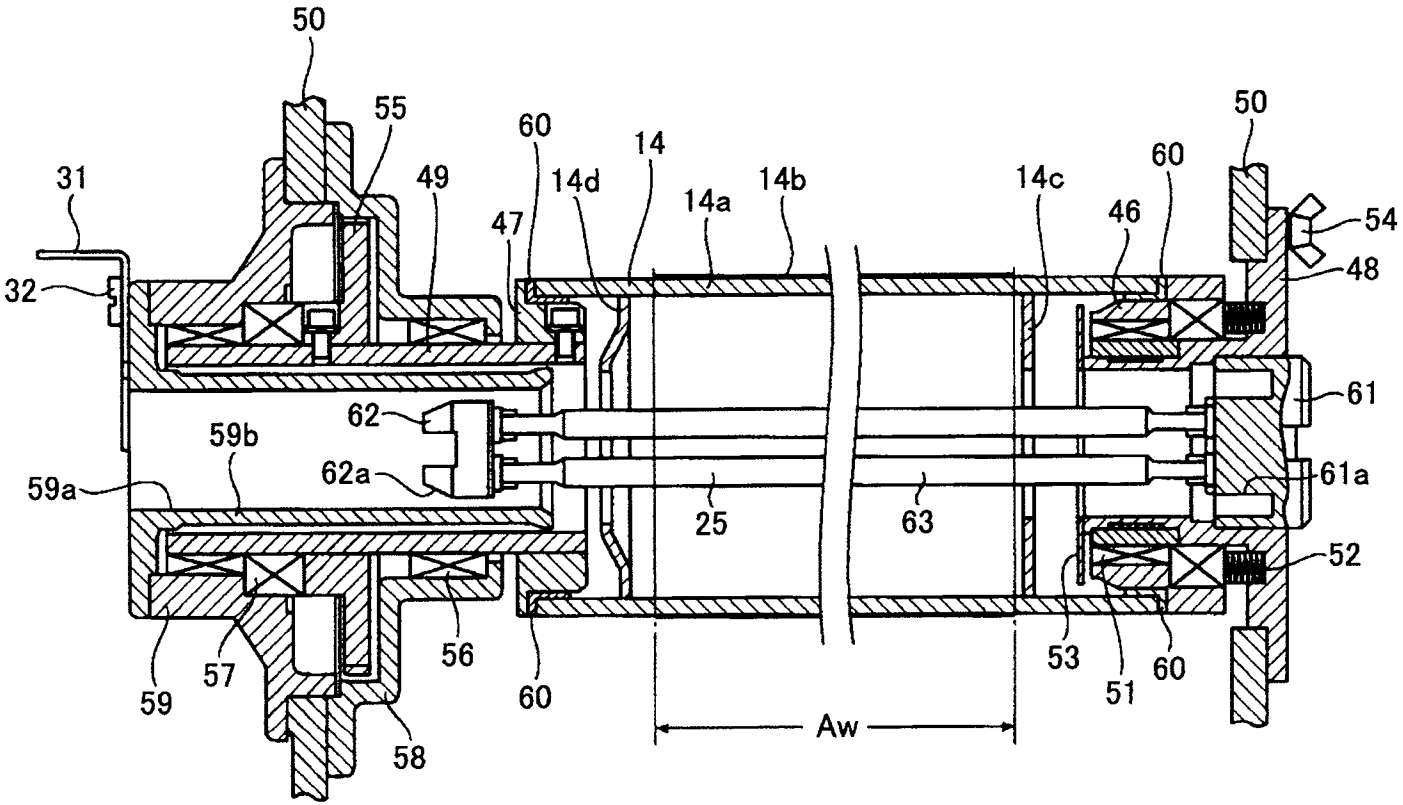
FIG. 5 is a cross section of a heating roller and adjacent components according to an embodiment of the present invention.

With reference to FIG. 5, the structure near the heating roller 14 of the fusing unit 12 is described. The heating roller 14 comprises a metal base pipe 14*a* of aluminum, for example, whose circumferential surface is covered with a surface layer 14*b* in a sheet-passage area Aw. The surface layer 14*b* may include a film of PFA (tetrafluoroethylene perfluoroalkoxy vinyl ether copolymer) resin or a silicon rubber layer. The silicon rubber layer may be covered with a PFA tube.

Inside the heating roller 14 near its openings at both ends, substantially disc-shaped heating roller lids (hereafter referred to as "absorbers") 14*c* and 14*d* which may be made of aluminum are fixed. The absorbers 14*c* and 14*d* are configured to prevent the radiation heat emitted by the heater lamps 25 within the heating roller 14 from being released to the outside, thus preventing a fluctuation of the surface temperature of the heating roller 14 or an increase in the temperature within the apparatus.

As illustrated in FIG. 5, the absorbers 14*c* and 14*d* are disposed somewhat outside the sheet-passage area Aw of the heating roller 14, so that the interval between the absorbers 14*c* and 14*d* is slightly longer than the length of the sheet-passage area Aw in the axial direction. The length of the heater lamps 25 is somewhat longer than the interval between the absorbers 14*c* and 14*d*.

When the absorbers 14*c* and 14*d* are entirely or partially disposed inside the sheet-passage area Aw of the heating roller 14, the transmission of radiation heat from the heater lamps 25 is hindered by the absorbers 14*c* and 14*d*, so that the surface temperature of the heating roller 14 may fail to reach a desired temperature. Thus, the absorbers 14*c* and 14*d* are disposed outside the sheet-passage area Aw of the heating roller 14.

The ends of the heating roller 14 are supported by frames 50, 50 of the fusing unit via retaining members 48 and 49 having centering members 46 and 47, respectively. The centering member 46 is disposed on the retaining member 48 via a bearing 51. The centering member 46 is inserted into one open end of the heating roller 14. The bearing 51 is configured to absorb dimensional variations of the heating roller 14 or the surrounding support members due to thermal expansion or the like, together with springs 52 disposed in a circumferential direction of the bearing 51 and a stopper plate 53 attached to an inner-end surface of the retaining member 48.

In an assembled state, the springs 52 are in a slightly compressed state such that, as illustrated in FIG. 5, a gap is formed between the centering member 46/the bearing 51 and the stopper plate 53. The retaining member 48 is fixed to one of the frames 50 with plural thumbscrews 54. The retaining member 49 is provided with a gear 55 that receives a drive force from a motor (not shown) for rotating the heating roller 14. The retaining member 49 is rotatably supported by housings 58 and 59 via bearings 56 and 57.

In an open-end portion of the heating roller 14 opposite the centering member 47, a key groove (not shown) is formed extending in the axial direction. On the other hand, on an end portion of the centering member 47, a key (not shown) is provided that fits into the key groove. The heating roller 14 and the centering member 47 are coupled with each other via such a key structure. Thus, the drive force from the motor can be transmitted via the gear 55, the retaining member 49, the centering member 47, and the key structure to the heating roller 14 so that the heating roller 14 can be rotated in a predetermined direction.

The position of the heating roller 14 in the axial direction is regulated by the retaining member 48, which is positioned on a front side (corresponding to the frame 50 via which the heating roller 14 is inserted; the side may be referred to as an "operation side"). The key of the centering member 47 and the corresponding key groove on the rear side of the heating roller 14 may be configured to have substantially the same width, so that the position of the heating roller 14 in the rotating direction can be regulated. The positions of the key and the key groove may be determined as desired. Preferably, the key and key groove are positioned such that they can be readily recognized. In accordance with the present embodiment, the key and the key groove are disposed out of alignment by 90° in the circumferential direction with respect to a holder 43 of a handle unit 40, which will be described later.

A similar key groove may also be provided on the front side of the heating roller 14. The key grooves on the front and rear sides may be disposed out of alignment by 180° in phase so that the heating roller 14 can be stabilized. More than one key groove may be provided on the front side and the rear side. Because the key and the key groove are displaced from the handle unit 40 by 90° as mentioned above, the positions of the key grooves on the front and rear sides are automatically determined when the handle unit 40 is aligned with the absorber 14*c*.

In order to prevent the outflow of heat from the heating roller 14 to the centering members 46 and 47 or the damage to the centering members 46 and 47, rings 60 are interposed between ends of the heating roller 14 and the corresponding centering members 46 and 47. The ring 60 may be made of heat-resistant synthetic resin. The ring 60 on the side of the centering member 47 includes a cut-out portion (not shown) formed at a position corresponding to the key groove of the heating roller 14, allowing the fitting of the key in the key groove.

The heater lamps 25 as the heat source of the heating roller 14 are bundled by lamp holders 61 and 62 that retain the ends of the heater lamps 25, thus forming a lamp cartridge 63. The lamp cartridge 63 is disposed at a central portion within the heating roller 14, as illustrated in FIG. 5, for example.

Lamp Protection Member and Roller Insertion/Removal Guide Shaft

With reference to FIGS. 6A through 6H, the structures of the lamp protection member 64 and the roller insertion/removal guide shaft 30 are described. The lamp protection member 64 is used at the time of replacing the lamp cartridge 63. The roller insertion/removal guide shaft 30 is used at the time of replacing the heating roller 14. The lamp protection member 64 and the roller insertion/removal guide shaft 30 are both cylindrical members. The lamp protection member 64 has an outer diameter which may be substantially identical to an inner diameter of the roller insertion/removal guide shaft 30. The lamp protection member 64 is configured to be inserted into and removed out of the roller insertion/removal guide shaft 30. The roller insertion/removal guide shaft 30 may be made of a metal or a heat-resistant hard synthetic resin having a required rigidity. On the other hand, the lamp protection member 64 may be made of paper or a soft synthetic resin so as to protect the lamp cartridge 63.

Figure 6A:
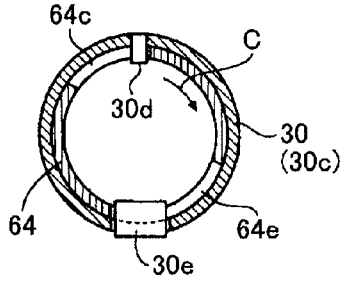
FIGS. 6A through 6H illustrate a process of unlocking a lamp protection member from a roller insertion/removal guide shaft.
Figure 6B:
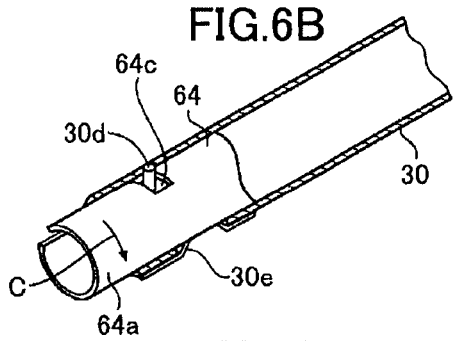
Figure 6C:
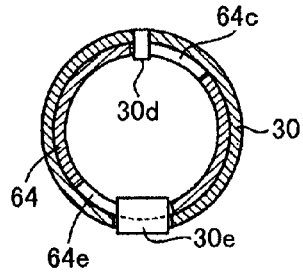

With reference to FIGS. 6A through 6H, a detach/attach mechanism for the lamp protection member 64 and the roller insertion/removal guide shaft 30 is described. As illustrated in FIG. 6A, a locking pin 30*d* is provided on an inner surface of a rear portion 30*c* of the roller insertion/removal guide shaft 30, the locking pin 30*d* extending into the roller insertion/removal guide shaft 30. The rear portion 30*c* refers to a rear-end portion of the roller insertion/removal guide shaft 30 that protrudes out of the image forming apparatus when attached at a predetermined position in the image forming apparatus, as illustrated in FIG. 7.

At a position opposite the locking pin 30*d*, a pressure spring 30*e* is disposed protruding into the roller insertion/removal guide shaft 30. The pressure spring 30*e* may include a plate spring with an inverted-V shape (in a side view), as illustrated in FIG. 6H or FIG. 7. The pressure spring 30*e* is inserted from the outside of the roller insertion/removal guide shaft 30 via a spring insertion opening 30*f* (see FIG. 6H). A base portion 30*e*-1 of the pressure spring 30*e* is fixed to the outer circumferential surface of the roller insertion/removal guide shaft 30, while an end portion 30*e*-2 (see FIG. 6F) of the pressure spring 30*e* comprises a free end that is not fixed to the roller insertion/removal guide shaft 30.

Figure 6D:
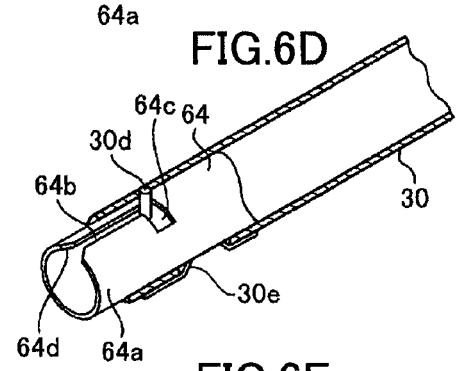
Figure 7:
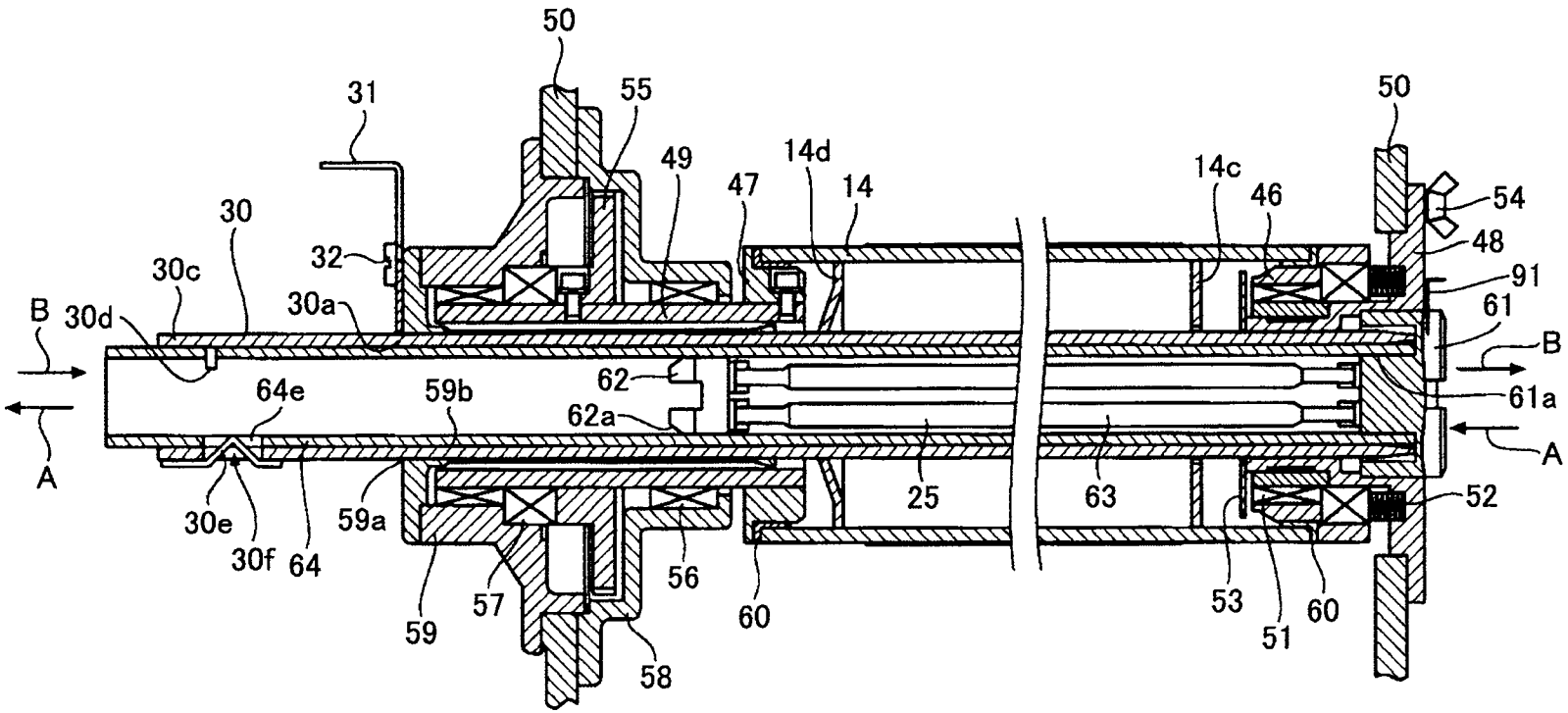
FIG. 7 is a cross section illustrating the roller insertion/removal guide shaft with the lamp protection member housed therein installed in the fusing unit according to an embodiment of the present invention.

For example, as illustrated in FIG. 6D, a guide groove 64*b* having a predetermined length is formed extending from one end portion 64*a* of the lamp protection member 64 along the axial direction. The end of the guide groove 64*b* opposite the end portion 64*a* merges with a locking groove 64*c* which is extended in a circumferential direction of the lamp protection member 64. Thus, an L- or hook-shaped (in plan view) groove is formed by the guide groove 64*b* and the locking groove 64*c*.

An open end of the guide groove 64*b* at the end portion 64*a* is provided with a tapered portion 64*d* so as to facilitate the insertion of the locking pin 30*d*. The guide groove 64*b* and the locking groove 64*c* may have widths slightly greater than the outer diameter of the locking pin 30*d*. Further, the circumferential wall of the lamp protection member 64 has a fitting opening 64*e* (see FIGS. 6A and 7, for example) opposite the locking groove 64*c*. The fitting opening 64*e* is of a size that accommodates an end portion of the pressure spring 30*e* and that permits the elastic deformation of the pressure spring 30*e*.

Figure 6E:
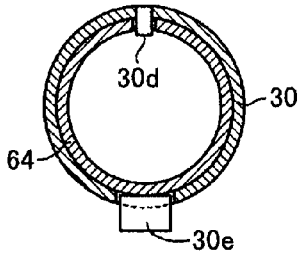
Figure 6F:
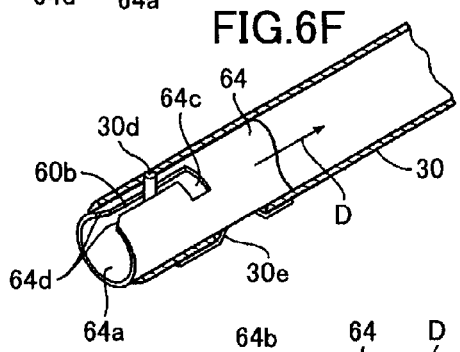
Figure 6G:
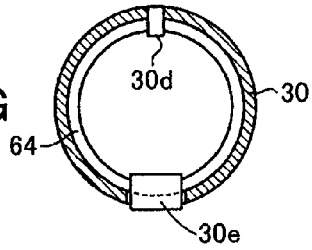
Figure 6H:
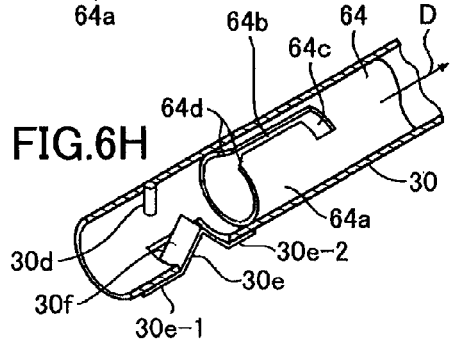

FIGS. 6A and 6B are a cross section and a partial perspective view, respectively, of the roller insertion/removal guide shaft 30 and the lamp protection member 64 inserted therein. FIGS. 6C and 6D are a cross section and a partial perspective view, respectively, illustrating a step of a process of removing the lamp protection member 64 from the roller insertion/removal guide shaft 30. FIGS. 6E and 6F are a cross section and a partial perspective view, respectively, illustrating a next step of the removing process. FIGS. 6G and 6H are a cross section and a partially perspective view, respectively, of the lamp protection member 64 having been unlocked from the roller insertion/removal guide shaft 30.

As illustrated in FIGS. 6A and 6B, the locking pin 30*d* of the roller insertion/removal guide shaft 30 is fitted in the locking groove 64*c* of the lamp protection member 64, while the pressure spring 30*e* of the roller insertion/removal guide shaft 30 is fitted in the fitting opening 64*e* of the lamp protection member 64. Thus, the lamp protection member 64 can be retained within the roller insertion/removal guide shaft 30, so that the lamp protection member 64 and the roller insertion/removal guide shaft 30 can be handled as if they were a single member.

Then, the lamp protection member 64 is rotated in a direction C while holding the roller insertion/removal guide shaft 30, until the locking pin 30*d* of the roller insertion/removal guide shaft 30 abuts against one end of the guide groove 64*b* of the lamp protection member 64, as illustrated in FIG. 6D, where the lamp protection member 64 cannot be rotated any more.

Next, as illustrated in FIG. 6F, the lamp protection member 64 is pulled in a direction D along the axial direction of the roller insertion/removal guide shaft 30. During this step, the locking pin 30*d* of the roller insertion/removal guide shaft 30 passes along the guide groove 64*b* of the lamp protection member 64. At the same time, the pressure spring 30*e* of the roller insertion/removal guide shaft 30 is pressed and elastically deformed outwardly by an edge of the fitting opening 64*e* of the lamp protection member 64, as illustrated in FIG. 6E. As illustrated in FIG. 6H, the pressure spring 30*e* has an inclined surface extending in the direction of insertion or removal of the lamp protection member 64, so that the pressure spring 30*e* can be moved into and out of the fitting opening 64*e* smoothly.

After the locking between the locking pin 30*d* and the locking groove 64*c* and the locking between the pressure spring 30*e* and the fitting opening 64*e* are released, the lamp protection member 64 can be pulled out in the direction D.

The lamp protection member 64 may be inserted into the roller insertion/removal guide shaft 30 in a procedure opposite to the procedure described above.

FIG. 7 illustrates the roller insertion/removal guide shaft 30 set within the image forming apparatus, with the lamp protection member 64 fitted inside the roller insertion/removal guide shaft 30. The rear portion 30*c* of the roller insertion/removal guide shaft 30 protrudes beyond the rear face of the image forming apparatus. A rear portion of the lamp protection member 64 protrudes even beyond the rear portion 30*c* of the roller insertion/removal guide shaft 30. Because the end of the lamp protection member 64 protrudes beyond the end of the roller insertion/removal guide shaft 30, the lamp protection member 64 can be easily rotated or pushed relative to the roller insertion/removal guide shaft 30.

In accordance with the present embodiment, the locking pin 30*d* is provided on the side of the roller insertion/removal guide shaft 30 while the guide groove 64*b* and the locking groove 64*c* are formed on the side of the lamp protection member 64. Conversely, the guide groove and the locking groove may be formed on the side of the roller insertion/removal guide shaft 30 and the locking pin may be provided on the side of the lamp protection member 64. However, if the configuration of the groove and the pin illustrated in FIG. 7 is simply reversed so that the pin is provided on the protection member 64, the guide groove would have to be provided from the position of the pin 30*d* provided on the roller insertion/removal guide shaft 30 to the end of the protection member 64 that is fitted in the groove portion of the lamp holder 61 (at the right end of FIG. 7) because the protection member 64 is removed in a direction B. Namely, in this case, the guide groove would be formed as a slit extending across most of the length of the roller insertion/removal guide shaft 30 in the axial direction. Such a structure, however, is not preferable from the viewpoint of rigidity. Thus, preferably, the pin may be provided on the protection member 64 at a position closer to the operation side (i.e., closer to the lamp holder 61). The pin has a height which is less than the thickness of the roller insertion/removal guide shaft 30.

Roller Replacement Support Tool

Next, a roller replacement support tool according to an embodiment of the present invention for the replacement of the heating roller 14 is described. The roller replacement supporting tool includes a roller insertion/removal guide shaft 30, a handle unit 40, and a support roller member 70.

The roller insertion/removal guide shaft 30 has a length which is a little longer than the interval between the left and right frames 50, 50, as illustrated in FIG. 7. The roller insertion/removal guide shaft 30 has an outer diameter substantially equal to an inner diameter of the retaining member 48, an inner diameter of the absorber 14*d*, and an inner diameter of an inner cylinder portion 59*b* of the housing 59. As mentioned above, the lamp protection member 64 can be installed within the roller insertion/removal guide shaft 30.

On an outer lateral surface of the housing 59, a plate-shaped stopper 31 for fixing (locking) the roller insertion/removal guide shaft 30 is slidably retained by a pin 32. On a circumferential wall of the roller insertion/removal guide shaft 30 closer to the rear portion 30*c*, there is provided a locking groove 30*a* in which the stopper 31 fits when the roller insertion/removal guide shaft 30 is inserted to a predetermined position.

When the roller insertion/removal guide shaft 30 is fixed (locked) at the predetermined position by the fitting of the stopper 31 in the locking groove 30*a*, the heating roller 14, the retaining member 48, and the handle unit 40 can be inserted or removed smoothly without causing the roller insertion/removal guide shaft 30 to be displaced in the axial direction, as will be described in detail later.

Figure 8:
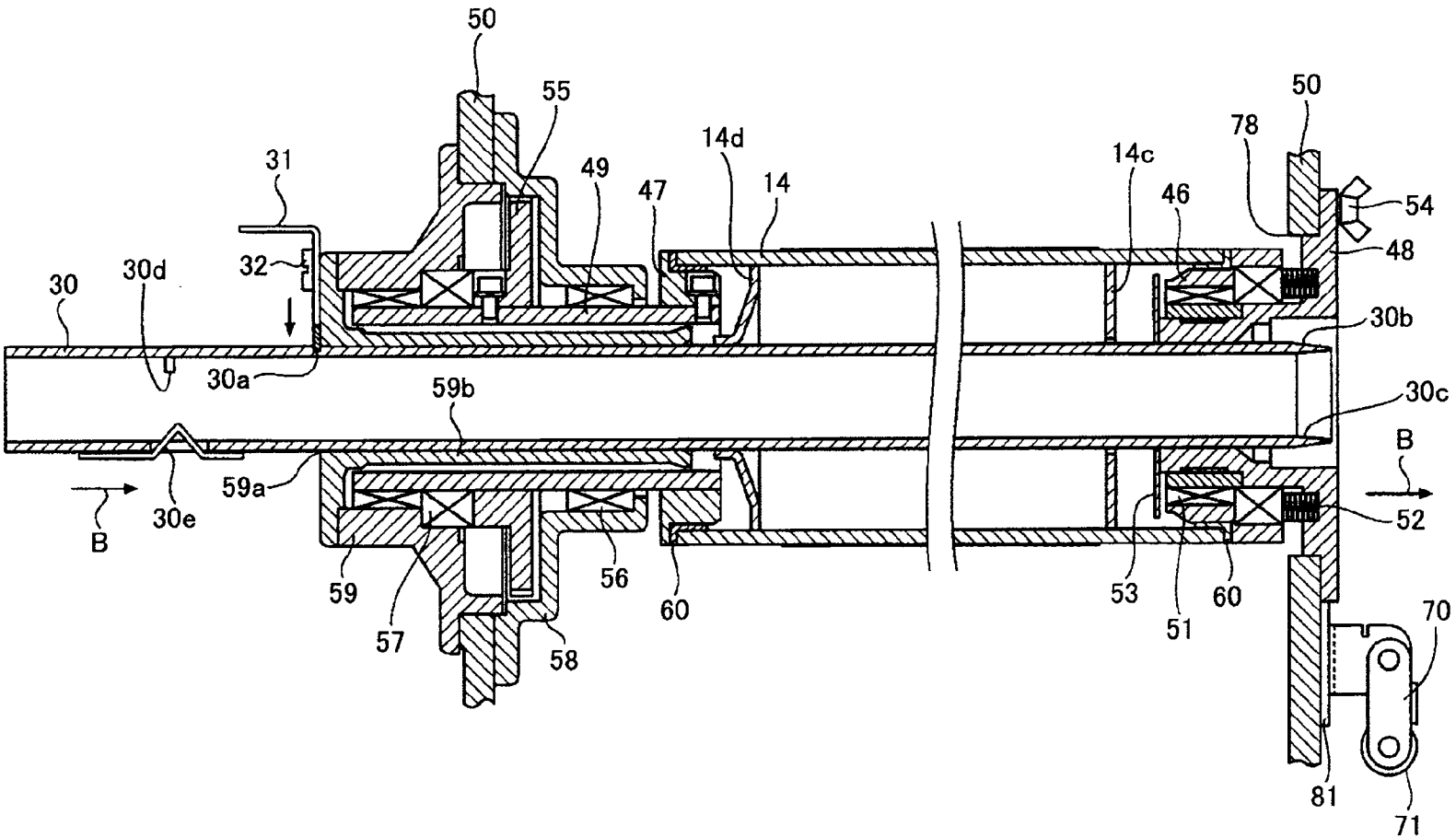
FIG. 8 is a cross section of the fusing roller from which the lamp protection member has been pulled out.

Referring to FIG. 8, an outer circumferential portion of the front end of the roller insertion/removal guide shaft 30 with respect to the direction of insertion is provided with an inclined surface 30*b* for allowing a smooth insertion of the handle unit 40 and the like. When the roller insertion/removal guide shaft 30 is fixed at a predetermined position, the front end (inclined surface 30*b*) of the roller insertion/removal guide shaft 30 protrudes a little beyond the side surface of the frame 50. Also, an internal circumferential portion of the front end of the roller insertion/removal guide shaft 30 is provided with an inclined surface 30*c*, as illustrated in FIG. 8, so that the lamp protection member 64 can be inserted smoothly.

Figure 10:
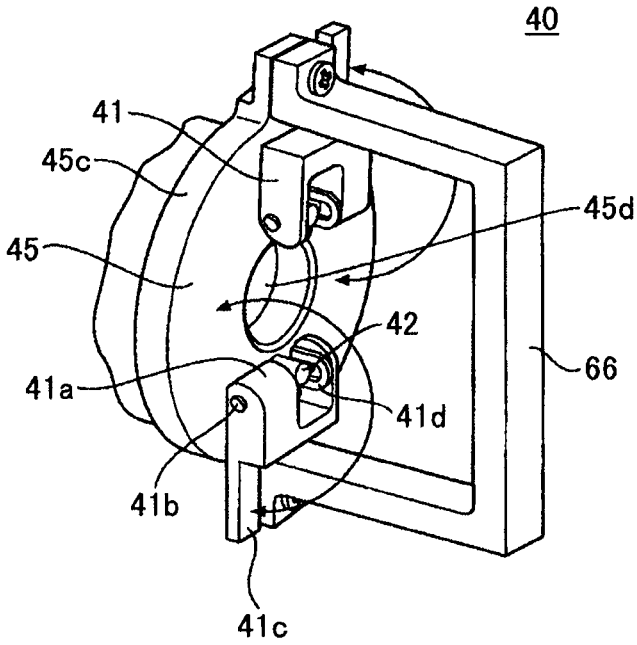
FIG. 10 is a perspective view of a handle unit according to an embodiment of the present invention.
Figure 11A:
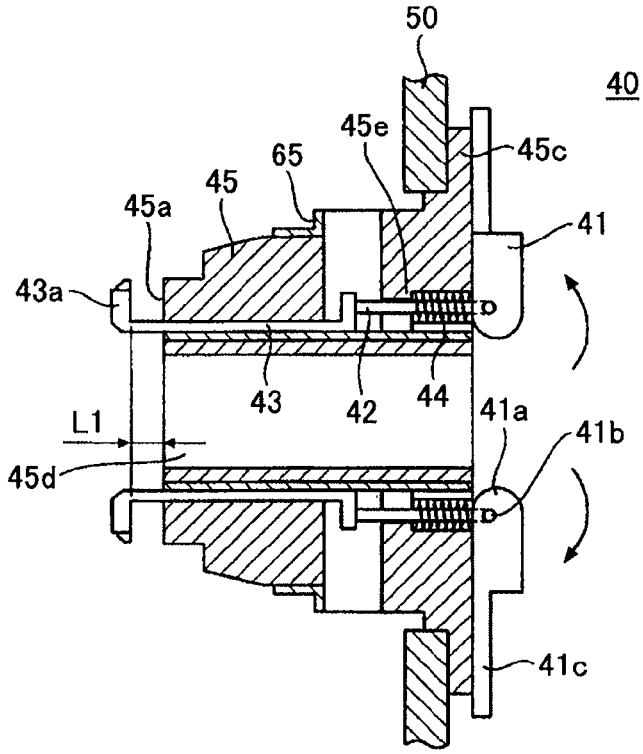
FIGS. 11A and 11B are cross sections of the handle unit in an open state and a closed state, respectively.
Figure 11B:
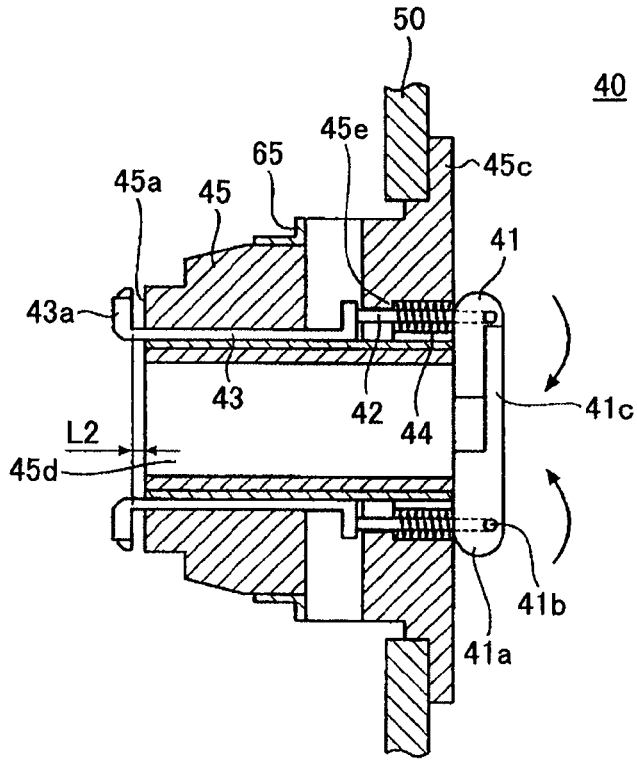

The handle unit 40, as illustrated in FIGS. 10 and 11, includes a handle unit main body 45; two latches 41 rotatably attached to a side of the handle unit main body 45; shafts 42 configured to transmit the movement of the latches 41 to the holders 43; the holders 43 (see FIGS. 11A and 11B) of which one end is coupled to the shafts 42 and the other end is bent outward; coil-shaped springs 44 for securely fixing the handle unit 40 to the heating roller 14 by absorbing the tolerance of components; and a handle 66 attached to the side of the handle unit main body 45.

Figure 18:
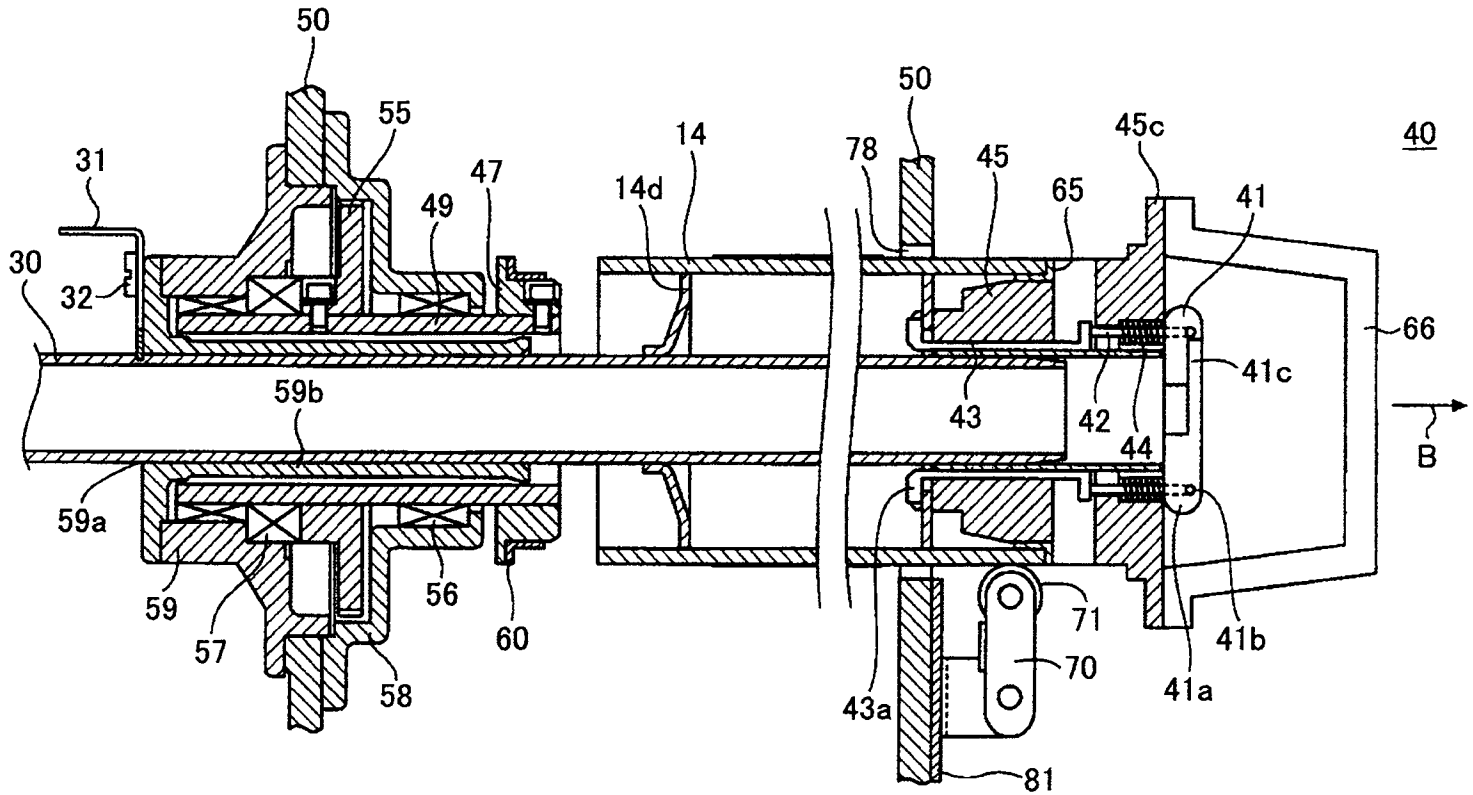
FIG. 18 is a cross section of the heating roller being pulled out of the fusing unit.

The handle unit main body 45 has a central insertion opening 45*d* extending along the axial direction. On one side of the handle unit main body 45, a flange portion 45*c* is formed. The handle unit main body 45 is attached to an open end of the heating roller 14 when replacing the heating roller 14, for example, via a ring 65, as illustrated in FIG. 18. The insertion opening 45*d* has an inner diameter which may be substantially identical to the outer diameter of the roller insertion/removal guide shaft 30.

The two latches 41 have identical shapes and each includes a semi-cylindrical rotating part 41*a* formed on one end, an axle portion 41*b* eccentrically provided on an inner side of the rotating part 41*a*, and a lever part 41*c* disposed on the other end opposite the rotating part 41*a*. The two latches 41 are attached to the handle unit main body 45 opposite to each other across the insertion opening 45*d*.

As illustrated in FIGS. 11A and 11B, one end of the shaft 42 is connected to the axle portion 41*b* of the latch 41. The holder 43 includes a pinching portion 43*a* at the end thereof opposite the end connected to the shaft 42. The pinching portion 43*a* is bent to face a side face 45*a* of the handle unit main body 45.

The coil-shaped spring 44 is disposed between a stepped-spring receiver portion 45*e* of the handle unit main body 45 and the latch 41. The latch 41 is resiliently biased in the outer direction by the resilience of the spring 44 at all times via the shaft 42 inserted within the spring 44. The latch 41 includes a stopper unit 41*d* as illustrated in FIG. 10.

In FIG. 11A, the lever parts 41*c* of the two latches 41 are opened away from each other in an open state. At this time, the axle portions 41*b* of the latches 41 are closer to the handle unit main body 45, so that there is a larger interval L1 between the pinching portions 43*a* of the holders 43 and the side face 45*a* of the handle unit main body 45. The interval L1 is a little larger than the thickness of the absorber 14*c*. FIG. 10 also illustrates the lever parts 41*c* of the latches 41 in the open status.

When the lever parts 41*c* of the latches 41 are both rotated inward, the axle portions 41*b* of the latches 41 are moved away from the handle unit main body 45, as illustrated in FIG. 11B. As a result, the shafts 42 and the holders 43 are also moved due to the eccentricity of the axle portions 41*b*, so that there is a smaller interval L2 between the pinching portions 43*a* of the holders 43 and the side face 45*a* of the handle unit main body 45. The interval L2 may be slightly smaller than the thickness of the absorber 14*c*.

Referring to FIGS. 12A through 12F, the support roller member 70 includes a roller plate 73 having a free end portion and a base portion. The roller plate 73 rotatably supports a support roller 71 via a first shaft 72. The base portion is rotatably supported by a holder plate 75 via a second shaft 74. One side of the roller plate 73 is bent into a hook 76 configured to be fitted in a groove portion 77 of the holder plate 75 (see FIG. 12E). The groove portion 77 may have a width substantially equal to the thickness of the hook 76. The holder plate 75 also includes an elongated opening 75*a* extending parallel to the groove portion 77. In the elongated opening 75*a*, the second shaft 74 is inserted. As will be described later, the roller plate 73 is supported in a vertically movable manner.

Figure 12A:
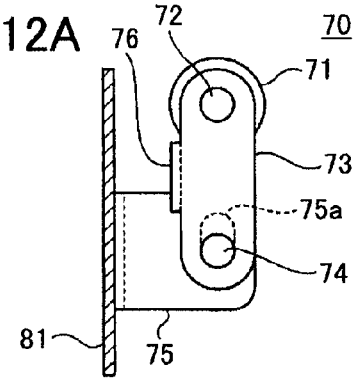
FIGS. 12A through 12F illustrate how a support roller member is operated when transitioning from an operating position (FIGS. 12A and 12B) to a stand-by position (FIGS. 12E and 12F) via an unlocked state (FIGS. 12C and 12D)
Figure 12B:
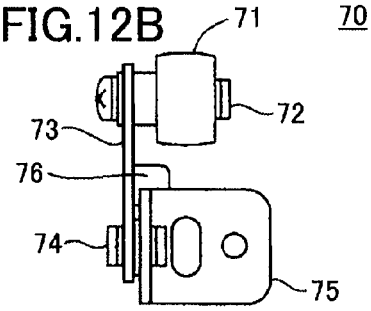

FIGS. 12A and 12B are a side view and a plan view, respectively, of the support roller member 70 in a position when the heating roller 14 is pulled out of or inserted into the image forming apparatus. As illustrated in FIG. 12A, the hook 76 of the roller plate 73 is locked in the groove portion 77 of the holder plate 75, so that the roller plate 73 is maintained in an upright position, with the support roller 71 facing a replacement opening 78 of the frame 50, as illustrated in FIG. 18.

Figure 12C:
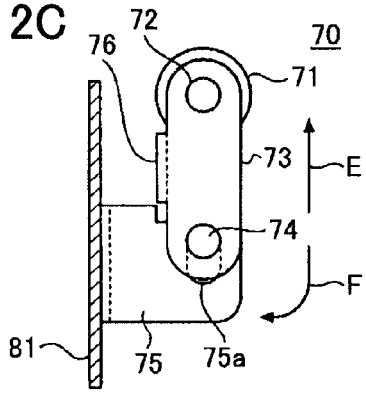
Figure 12D:
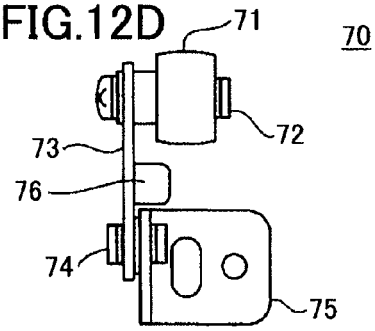

FIGS. 12C and 12D are a side view and a plan view, respectively, of the support roller member 70 during a transition from the operating position of FIGS. 12A and 12B to a stand-by position, as will be described later. As illustrated in FIG. 12C, the roller plate 73 is raised in a direction E so that the hook 76 is unlocked from the groove portion 77. Thereafter, the roller plate 73 is rotated in a direction F about the second shaft 74 by approximately 180°.

Figure 12E:
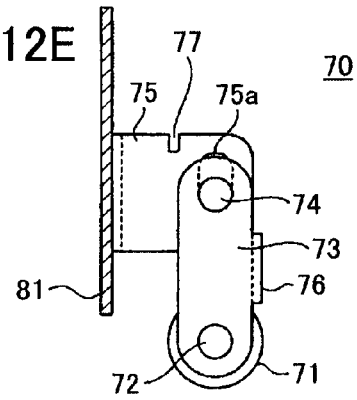
Figure 12F:
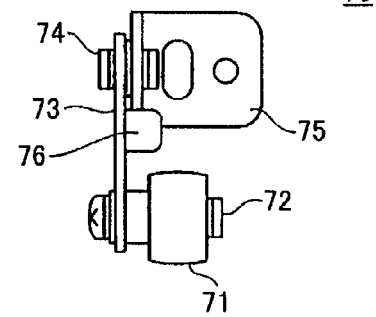

FIGS. 12E and 12F are a side view and a plan view, respectively, of the support roller member 70 in the stand-by position. In this position, the roller plate 73 is hung on the second shaft 74, with the support roller 71 in a lower position separated away from the replacement opening 78 of the frame 50, as illustrated in FIG. 8.

Figure 13:
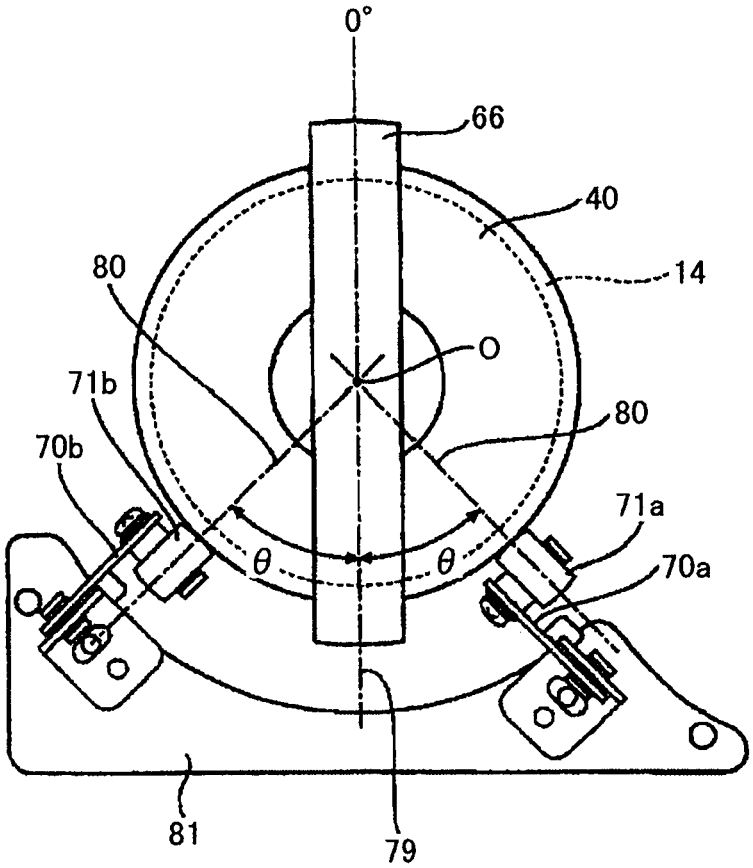
FIG. 13 illustrates an arrangement of two support roller members relative to the handle unit according to an embodiment of the present invention.

FIG. 13 illustrates the arrangement of the support roller member 70 with respect to the handle unit 40. In accordance with the present embodiment, the support roller member 70 includes two support roller members 70*a* and 70*b*. The support roller members 70*a* and 70*b* are disposed near the replacement opening 78 of the frame 50 such that they can support the movement of the heating roller 14 when it is pulled out by holding the handle 66 of the handle unit 40 with hand.

Figure 14:
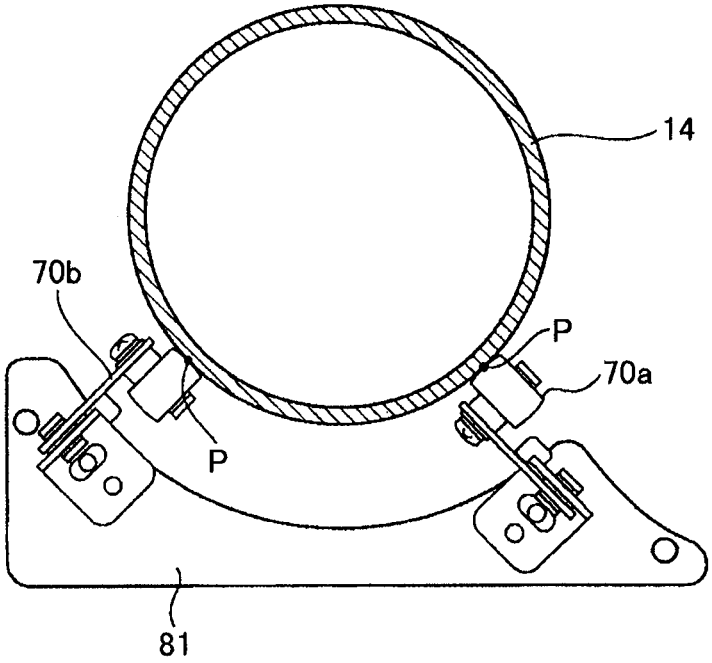
FIG. 14 illustrates how the heating roller is supported by the two support roller members.

Specifically, the two support roller members 70*a* and 70*b* are disposed under the heating roller 14 and, as illustrated in FIG. 13, horizontally symmetrically with respect to a vertical line 79 passing through a roller center O of the heating roller 14, such that center lines 80 perpendicular to the roller axes of the support rollers 71*a* and 71*b* intersect the vertical line 79 at an angle θ which may be in a range of ±30° to ±60° and preferably ±40° to ±50° (45° in the present embodiment). In this way, the support roller members 70*a* and 70*b* can support the heating roller 14 stably at points P, as illustrated in FIG. 14, without interfering with the movement of the heating roller 14 as it is pulled out using the handle unit 40, thus eliminating the destabilizing factors during the removal of the heating roller 14. The support roller members 70*a* and 70*b* are horizontally symmetrically attached to an attaching plate 81 which is fixed on the outside of the frame 50 via the attaching plate 81 (see FIG. 8).

Preferably, one or more support roller members 70 may be disposed on top of the heating roller 14, in addition to the two support roller members 70*a* and 70*b* under the heating roller 14. In such an embodiment, the additional support roller members 70 need to be disposed such that they do not obstruct the pulling-out of the heating roller 14 by the handle unit 40, as in the case of the lower support roller members 70*a* and 70*b*. A certain amount of gap may be provided between the additional upper support roller members 70 and the heating roller 14 such that the support roller members 70 do not exert an excessive restraining force on the heating roller 14.

Detaching/Attaching of Lamp Cartridge

When the lamp cartridge 63 is pulled out of the heating roller 14, the lamp protection member 64 together with the roller insertion/removal guide shaft 30 is inserted in a direction B via the through-hole 59*a* of the housing 59, as illustrated in FIG. 7, while being guided by the inner cylinder portion 59*b* of the housing 59, the inclined portion 62*a* of the lamp holder 62, and the retaining member 48.

The lamp protection member 64 may have an inner diameter which is substantially identical to the outer diameter of the lamp holder 62 and that of the small-diameter portion 61*a* of the lamp holder 61. The lamp protection member 64 (together with the roller insertion/removal guide shaft 30) is inserted until its front end is fitted into the end of the small-diameter portion 61*a* of the lamp holder 61. Thus, the lamp protection member 64 is held in the lamp holder 61 by the frictional force between the lamp protection member 64 and the small-diameter portion 61*a*.

As illustrated in FIG. 7, a plate-shaped stopper 91 is provided on a front face of the retaining member 48. The stopper 91 is vertically movable so that it can fix (lock) the lamp holder 61, thus preventing the detachment of the lamp holder 61. On a circumferential surface of the lamp holder 61, a corresponding locking groove (not shown) is provided in which a lower end of the stopper 91 can be fitted.

As mentioned above, when the lamp protection member 64 is held in the lamp holder 61, the stopper 91 is raised so as to release the locking of the lamp holder 61, and then the stopper 91 is fixed in the upper position using a screw (not shown) or the like. Then, the lamp protection member 64 is rotated in a direction C by about 45°, as illustrated in FIG. 6A, while holding a rear-end portion of the lamp protection member 64 which is protruding beyond the rear portion 30*c* of the roller insertion/removal guide shaft 30 (see FIG. 7) with one hand. Thus, the locking of the lamp protection member 64 by the roller insertion/removal guide shaft 30 is released.

Thereafter, the lamp protection member 64 is pushed in a direction D, as illustrated in FIGS. 6F and 6H. As a result, the lamp holder 61 is pushed out together, so that the lamp protection member 64 with the lamp holder 61 accommodated therein can be removed from the image forming apparatus. A retaining force applied from the pressure spring 30*e* to the lamp protection member 64 in the status of FIG. 6E is set to be lower than the retaining force due to the fitting (frictional force) between the lamp protection member 64 and the small-diameter portion 61*a* of the lamp holder 61.

When inserting the lamp cartridge 63 into the heating roller 14, the lamp cartridge 63 is inserted from the opening portion of the lamp protection member 64 opposite the side where the guide groove 64*b* and the like is formed. The smooth insertion of the lamp cartridge 63 is facilitated by the inclined portion 62*a* at the tip of the lamp holder 62, as illustrated in FIG. 7. By fitting the open end of the lamp protection member 64 in the small-diameter portion 61*a* of the lamp holder 61, the storage of the lamp cartridge 63 in the lamp protection member 64 is completed.

The lamp protection member 64 with the lamp cartridge 63 housed therein is inserted into the roller insertion/removal guide shaft 30 from the tapered portion 64*d* (see FIG. 6D) in the direction A of FIG. 7. At this time, in order to ensure that the tapered portion 64*d* of the lamp protection member 64 is positioned opposite the locking pin 30*d* in the roller insertion/removal guide shaft 30, a marker (not shown), such as a line, may be drawn on the front face of the retaining member 48 and the circumferential surface of the lamp protection member 64 for position-aligning purposes. Thus, the lamp protection member 64 may be inserted into the roller insertion/removal guide shaft 30 with reference to the marker. At this time, the inner circumferential surface of the roller insertion/removal guide shaft 30 may function as an insertion guide for the lamp protection member 64.

Just before completion of insertion of the lamp protection member 64, the tapered portion 64*d* of the lamp protection member 64 is positioned opposite the locking pin 30*d* in the roller insertion/removal guide shaft 30. As the lamp protection member 64 is further inserted, the locking pin 30*d* is guided by the tapered portion 64*d* and relatively inserted into the guide groove 64*b* (see FIG. 6F) until the locking pin 30*d* abuts against the end of the guide groove 64*b* (see FIG. 6D).

At this stage, as illustrated in FIG. 7, the front end of the lamp protection member 64 is protruding beyond the end portion 30*c* of the roller insertion/removal guide shaft 30. Then, by holding the front-end portion of the lamp protection member 64 and the end portion 30*c* of the roller insertion/removal guide shaft 30 with both hands, the lamp protection member 64 is rotated in a direction opposite to the direction C of FIG. 6A relative to the roller insertion/removal guide shaft 30.

In this way, the locking pin 30*d* of the roller insertion/removal guide shaft 30 enters the locking groove 64*c* of the lamp protection member 64. As a result, the locking pin 30*d* and the locking groove 64*c* are locked with each other as illustrated in FIG. 6B, so that the lamp protection member 64 is integrally connected within the roller insertion/removal guide shaft 30.

Thereafter, the stopper 31 is raised to release the lock with the roller insertion/removal guide shaft 30, and then the roller insertion/removal guide shaft 30, together with the lamp protection member 64, is pulled out of the image forming apparatus in the direction A, as illustrated in FIG. 7, thus completing the attaching of the lamp holder 61.

Thus, by covering the lamp cartridge 63 with the lamp protection member 64 upon removal or insertion of the lamp cartridge 63, the heater lamps 25 can be prevented from being damaged during the handling of the lamp cartridge 63. Preferably, the lamp protection member 64 may comprise a paper cylinder having sufficient mechanical strength and heat-shielding property, as such paper cylinders are relatively inexpensive and readily available.

Procedure for Replacing the Heating Roller

Figure 15:
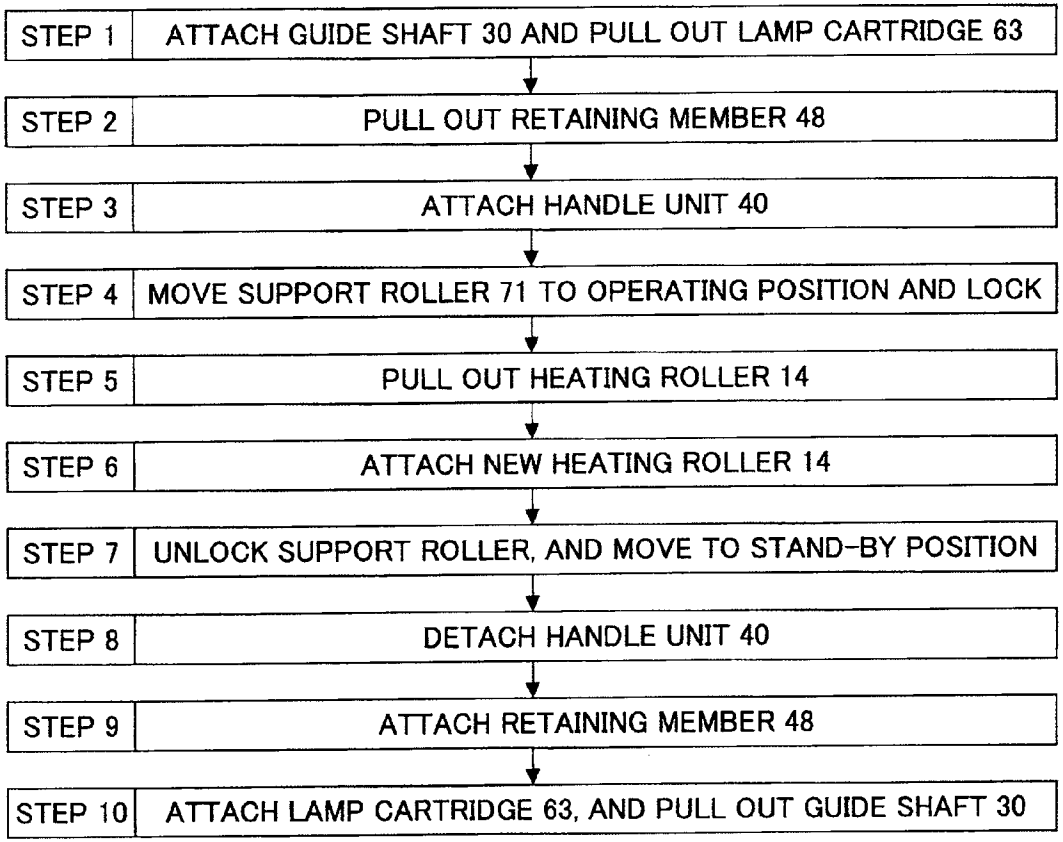
FIG. 15 illustrates a procedure for replacing the heating roller according to an embodiment of the present invention.

A procedure for replacing the heating roller 14 is described. The replacement of the heating roller 14 may be required at the end of its lifespan, or in order to address the requirements of the printer. FIG. 15 illustrates the procedure for replacing the heating roller 14. In step 1, the roller insertion/removal guide shaft 30 with the lamp protection member 64 fitted therein is installed in the image forming apparatus (see FIG. 7), and then the lamp cartridge 63 is pulled out of the heating roller 14 together with the lamp protection member 64, as described above with reference to the operation for detaching/attaching the lamp cartridge. The roller insertion/removal guide shaft 30 from which the lamp protection member 64 and the lamp cartridge 63 have been removed is illustrated in cross section in FIG. 8. The lamp cartridge 63 pulled out of the image forming apparatus may be left in the lamp protection member 64 in order to prevent damage to the lamp cartridge 63 during the replacing operation. The lamp cartridge 63, if it is old, may be replaced with a new lamp cartridge 63 at this time.

In step 2, the thumbscrew 54 is unfastened and the retaining member 48 that retains the centering member 46, the bearing 51, the spring 52, the stopper plate 53 and the like is pulled out in the direction B. At this time, the end portion of the roller insertion/removal guide shaft 30 is slightly protruding beyond the outer side face of the frame 50. Thus, the retaining member 48 can be smoothly removed while being guided by the guide shaft 30 without colliding with the open end of the roller insertion/removal frame 50, for example. During the pulling operation, as the centering member 46 is separated from the heating roller 14, the centering member 46 and the bearing 51 may abut the stopper plate 53 due to the resilience of the spring 52. At this time, as illustrated in FIG. 8, the support roller 71 of the support roller member 70 is in the stand-by position (lower position), thus not interfering with the removal operation for the retaining member 48.

In step 3, the handle unit 40 is inserted via the front-end portion of the roller insertion/removal guide shaft 30 where the inclined surface 30*b* is formed, by holding the handle 66. At this time, the lever parts 41*c* of the latches 41 are in the open state, as illustrated in FIG. 11A. Thus, there is the wider interval L1 between the side face 45*a* of the handle unit main body 45 and the pinching portions 43*a* of the holders 43.

Figure 16A:
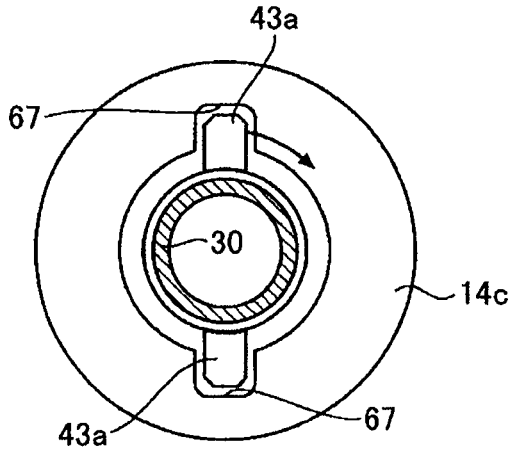
FIGS. 16A and 16B are cross sections taken along line X-X' of FIG. 17, illustrating the relationship between an absorber provided in the heating roller and a pinching portion of a holder of the handle unit.
Figure 16B:
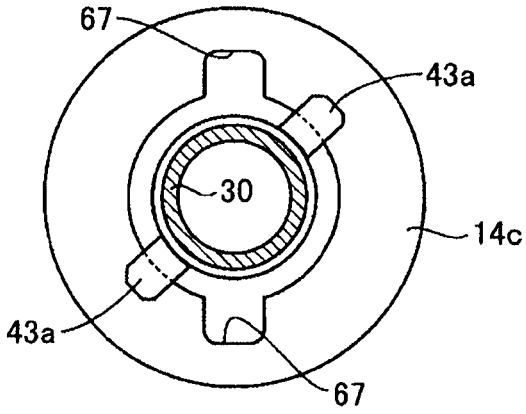
Figure 17:
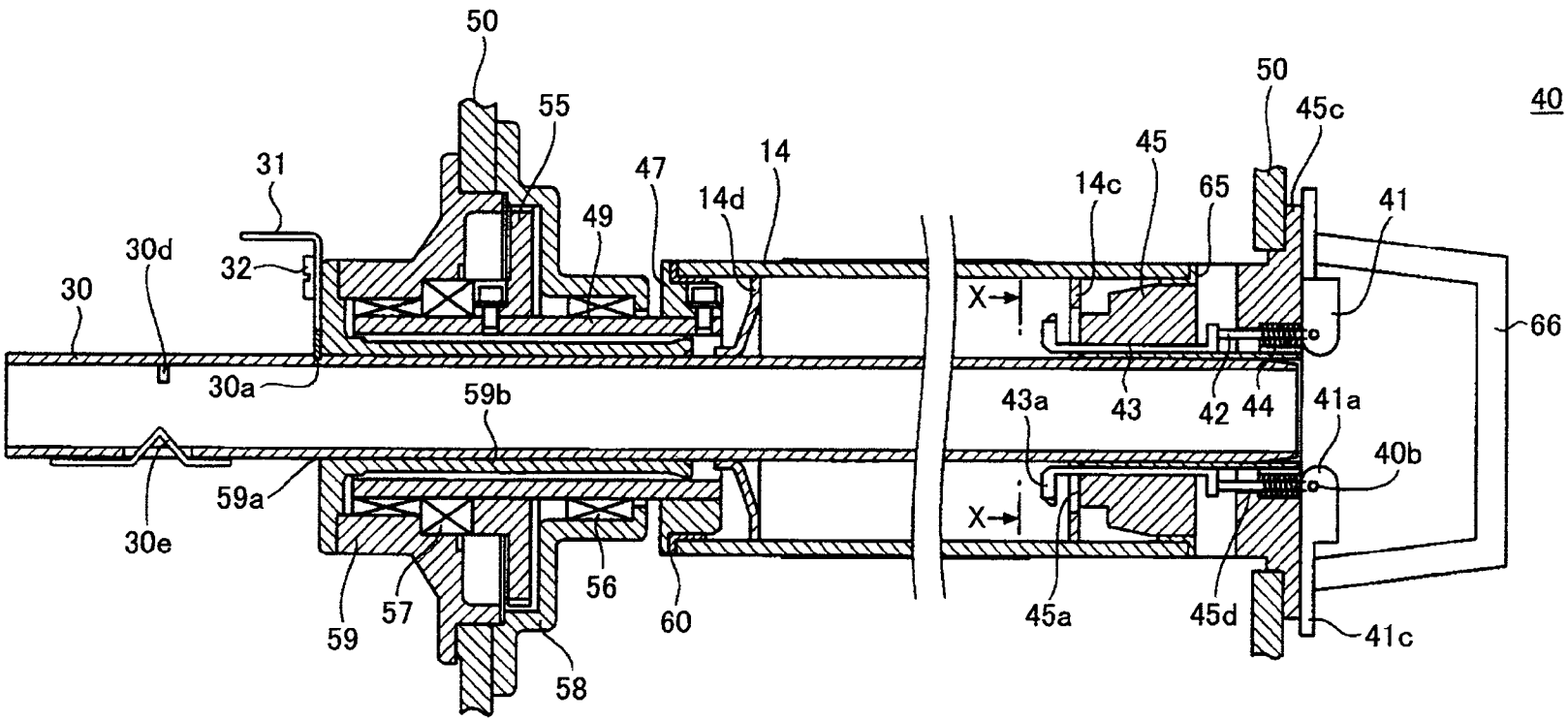
FIG. 17 is a cross section of the heating roller to which the handle unit is attached.

FIGS. 16A and 16B are cross sections taken along line X-X of FIG. 17, illustrating the relationship between the absorber 14*c* and the pinching portions 43*a* of the holder 43. FIG. 16A illustrates the handle unit 40 having been just inserted into the heating roller 14. FIG. 16B illustrates the handle unit 40 having been securely attached to the absorber 14*c*.

Referring to FIG. 16A, the absorber 14*c* has two cut-out portions 67 which are formed opposite to each other in an inner circumferential portion of the absorber 14*c*. The cut-out portions 67 are of a size that permits the passing of the pinching portion 43*a* of the holder 43. When the handle unit 40 is inserted into the heating roller 14, as illustrated in FIG. 17, the pinching portions 43*a* of the holder 43 pass through the cut-out portions 67 of the absorber 14*c* and are positioned to the left of the absorber 14*c* in FIG. 17. The insertion of the absorber 14*c* is stopped when the flange portion 45*c* of the handle unit main body 45 abuts the outer side face of the frame 50.

Then, the handle unit 40 is rotated in the direction of the arrow indicated in FIG. 16A by a predetermined angle, whereby the pinching portions 43*a* of the holder 43 are displaced out of the cut-out portions 67 and positioned opposite other inner circumferential portions of the absorber 14*c*, as illustrated in FIG. 16B. In this state, the lever parts 41*c* of the two latches 41 are both inwardly rotated into a closed state, as illustrated in FIG. 11B. As a result, the pinching portions 43*a* of the holders 43 are pulled toward the handle unit main body 45 via the shafts 42, so that the inner circumferential portion of the absorber 14*c* can be pinched between the pinching portion 43*a* of the holder 43 and the side face 45*a* of the handle unit main body 45. In this way, the handle unit 40 is attached to the heating roller 14 via the absorber 14*c*.

Figure 9:
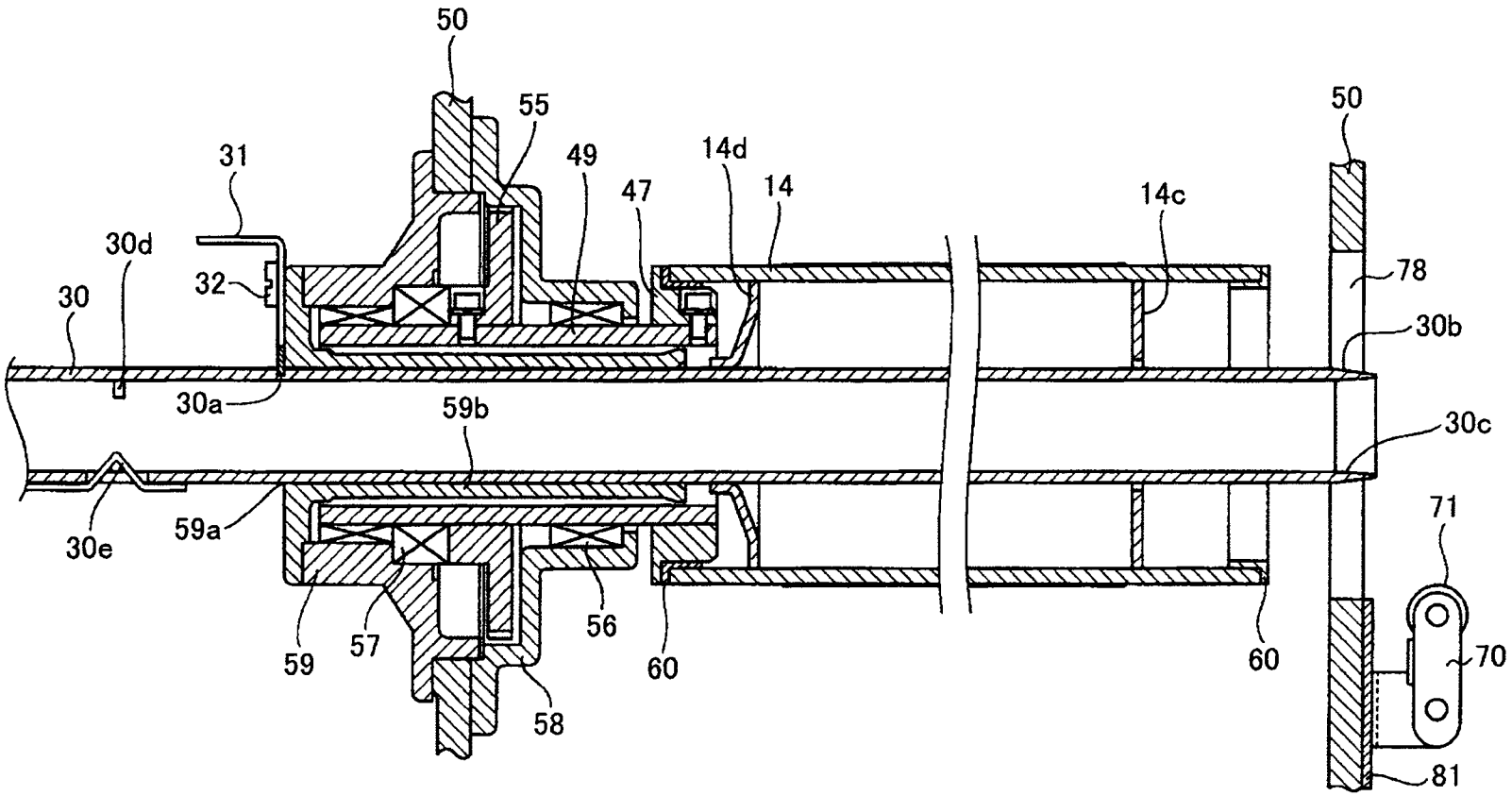
FIG. 9 is a cross section of the fusing roller from which a roller retaining member on one end of the heating roller has been removed.

In step 4, the support roller 71 is moved to the operating position and locked therein. Specifically, the support roller member 70 in the position of FIG. 12E is rotated in a direction opposite to the direction F by 180°, and the hook 76 is fitted in the groove portion 77, as illustrated in FIG. 12A. Thus, the support roller 71 is positioned opposite the replacement opening 78 of the frame 50, as illustrated in FIG. 9.

In step 5, the heating roller 14 which may still be in a high-temperature state is pulled out of the image forming apparatus by holding the handle 66 of the handle unit 40.

During this operation, the roller insertion/removal guide shaft 30 is reliably held by the inner cylinder portion 59*b* of the housing 59, so that the heating roller 14 can be smoothly pulled out, with the inner circumferential portion of the absorber 14*d* sliding on the outer circumferential surface of the roller insertion/removal guide shaft 30.

The portion of the heating roller 14 that protrudes out of the frame 50 is stably supported by the support rollers 71*a* and 71*b*, as illustrated in FIG. 14, the support rollers 71*a* and 71*b* rotating as the heating roller 14 is pulled out. In this way, the heating roller 14 can be removed smoothly and safely without having to hold any part of the heating roller 14 which may have a temperature of about 200° C. Even after the heating roller 14 is pulled out, the centering member 47 and the retaining member 49 are left. FIG. 18 illustrates the heating roller 14 being pulled out.

In step 6, the handle unit 40 is attached to a new heating roller 14 for replacement (not shown), and the new heating roller 14 is installed together with the handle unit 40, using the roller insertion/removal guide shaft 30. Also during this attaching operation, the support rollers 71*a* and 71*b* are used to ensure a smooth insertion of the new heating roller 14. In step 7, the support rollers 71*a* and 71*b* are unlocked and moved to the stand-by position, as described above with reference to FIGS. 12A and 12E.

In step 8, the handle unit 40 is removed out of the heating roller 14. In step 9, the retaining member 48 is attached using the roller insertion/removal guide shaft 30. In step 10, the lamp cartridge 63 covered with the lamp protection member 64 is installed within the heating roller 14 while being guided by the roller insertion/removal guide shaft 30. Thereafter, the stopper 31 is removed and the roller insertion/removal guide shaft 30 is pulled out together with the lamp protection member 64, thus completing the replacement of the heating roller 14.

The operation for installing the new heating roller 14 in step 6 may be a reversal of the operation of pulling out the heating roller 14 in step 5. The operation of unlocking and moving the support roller 71 to the stand-by position in step 7 may be a reversal of the operation of attaching the handle unit 40 in step 3. The operation of removing the handle unit 40 in step 8 may be a reversal of the operation of attaching the handle unit 40 in step 3. The operation of attaching the retaining member 48 in step 9 may be a reversal of the operation of pulling out the retaining member 48 in step 2. The operation of attaching the lamp cartridge 63 and pulling out the roller insertion/removal guide shaft 30 in step 10 may be a reversal of the operation of attaching the roller insertion/removal guide shaft 30 and pulling out the lamp cartridge 63 in step 1.

While the foregoing embodiment is directed to the replacement of the heating roller 14, an embodiment of the present invention may be applied to the replacement of a heat source (lamp cartridge) provided in the pressure roller 15. When the pressure roller 15 having no lamp cartridge has the same shape as that of the opposite heating roller 14, the replacement support tool without the lamp protection member 64 may be applied for the replacement of the pressure roller 15. In this case, it is not necessary to prepare more than one replacement support tool, so that the storage and maintenance of the replacement jig require less space and expense.

The mold release agent or lubricant may be applied to the pressure roller 15 or the heating roller 14, or both, in the fusing unit (image forming apparatus). Although this invention has been described in detail with reference to certain embodiments, variations and modifications exist within the scope and spirit of the invention as described and defined in the following claims.

The present application is based on Japanese Priority Application No. 2010-024472 filed Feb. 5, 2010, the entire contents of which are hereby incorporated by reference.

What is claimed is:

1. A component replacement support tool for a fusing unit having a roller that contains a lamp cartridge, the fusing unit including a replacement opening via which the roller or the lamp cartridge can be removed from or inserted into the fusing unit along an axis of the roller for replacement, the tool comprising:

a roller insertion/removal guide shaft; and a lamp protection member detachably housed in the roller insertion/removal guide shaft, wherein the roller insertion/removal guide shaft is configured to be inserted into the roller along the axis of the roller and fixed therein so as to guide the roller when the roller is removed from or inserted into the fusing unit via the replacement opening, the lamp protection member is inserted between the roller and the lamp cartridge when the lamp cartridge is pulled out of or inserted into the roller along the axis of the roller via the replacement opening.

2. The component replacement support tool for a fusing unit according to claim 1, further comprising a locking structure for locking the lamp protection member in the roller insertion/removal guide shaft, the locking structure including a locking groove provided in one of the lamp protection member and the roller insertion/removal guide shaft, and a guide pin provided on the other of the lamp protection member and the roller insertion/removal guide shaft, wherein the locking groove includes a first groove portion extending from an open end of the one of the roller insertion/removal guide shaft and the lamp protection member in a direction parallel to the axis of the roller, and a second groove portion extending from an end of the first groove portion in a direction perpendicular to the axis of the roller, wherein the pin is configured to be fitted in the locking groove when the lamp protection member is housed in the roller insertion/removal guide shaft, wherein the lamp protection member is locked in the roller insertion/removal guide shaft when the pin is located in the second groove portion, wherein the lamp protection member is unlocked from the roller insertion/removal guide shaft when the pin is not located in the locking groove.

3. The component replacement support tool for a fusing unit according to claim 2, wherein the roller insertion/removal guide shaft and the lamp protection member housed therein have rear portions that protrude out of the fusing unit when the roller insertion/removal guide shaft with the lamp protection member housed therein is installed in the fusing unit, wherein the rear portion of the lamp protection member protrudes more than the rear portion of the roller insertion/removal guide shaft.

4. The component replacement support tool for a fusing unit according to claim 1, further comprising a stopper that prevents the roller insertion/removal guide shaft installed in the fusing unit from moving in a direction parallel to the axis of the roller.

5. The component replacement support tool for a fusing unit according to claim 1, wherein the lamp protection member has an outer diameter substantially identical to an inner diameter of the roller insertion/removal guide shaft so that the lamp protection member can be guided by the roller insertion/removal guide shaft when the lamp protection member is inserted into or pulled out of the roller insertion/removal guide shaft.

6. The component replacement support tool for a fusing unit according to claim 1, wherein the roller insertion/removal guide shaft has an outer diameter substantially identical to a diameter of a through-hole of a roller lid provided near the open end of the roller, wherein the roller insertion/removal guide shaft is passed through the through-hole of the roller lid when being inserted into or pulled out of the fusing unit.

7. The component replacement support tool for a fusing unit according to claim 1, wherein, the roller insertion/removal guide shaft includes a metal cylinder, and the lamp protection member includes a paper cylinder.

8. The component replacement support tool for a fusing unit according to claim 1, further comprising a handle unit that can be detachably attached to a front-end portion of the roller in order to support the roller during insertion or removal, wherein the handle unit includes a roller connecting portion configured to be connected with the roller, and a handle portion configured to be held by hand.

* * * * *